US009681694B2

(12) United States Patent
Ng et al.

(10) Patent No.: US 9,681,694 B2
(45) **Date of Patent: *Jun. 20, 2017**

(54) FULLY FASHION KNITWEAR AND A METHOD AND SYSTEM FOR MAKING THREE-DIMENSIONAL PATTERNS FOR THE SAME

(71) Applicant: Artlink International Development Limited, Hong Kong (HK)

(72) Inventors: Keng Po Roger Ng, Hong Kong (HK); Tin-yee Clement Lo, Hong Kong (HK); Chun Ting Cheung, Hong Kong (HK); Ting Man Lam, Hong Kong (HK); Jinyun Zhou, Hong Kong (HK)

(73) Assignee: Artlink International Development Limited, Kwai Fong, New Territories (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/130,877

(22) Filed: Apr. 15, 2016

(65) Prior Publication Data

US 2016/0309822 A1 Oct. 27, 2016

(30) Foreign Application Priority Data

Apr. 21, 2015 (HK) ..... 15103860.4
Apr. 21, 2015 (HK) ..... 15103861.3

(51) Int. Cl.
*A41H 3/04* (2006.01)
*D04B 37/02* (2006.01)
(Continued)

(52) U.S. Cl.
CPC ..... *A41H 3/04* (2013.01); *A41H 3/007* (2013.01); *D04B 1/24* (2013.01); *D04B 37/00* (2013.01); *D04B 37/02* (2013.01)

(58) Field of Classification Search
CPC ..... D04B 15/66; D04B 37/00; D04B 37/02; D04B 37/06
(Continued)

(56) References Cited

U.S. PATENT DOCUMENTS 5,557,527 A * 9/1996 Kotaki ..... D04B 15/66 66/232
6,310,627 B1 * 10/2001 Sakaguchi ..... A41H 3/007 345/630
(Continued)

*Primary Examiner* — Danny Worrell
(74) *Attorney, Agent, or Firm* — Idea Intellectual Limited; Margaret A. Burke; Sam T. Yip

(57) ABSTRACT

A fully fashion knitwear made by using a method for generation of contour fit three-dimensional (3D) fully fashion knitwear pattern based on 3D body data of an individual. The method comprises the following steps: digitizing an individual to create a 3D body data cloud; automatically recognizing body landmarks; extracting the body measurements; calculating the garment pattern block of the digitized surface of the individual according to the extracted body measurements including geodesic (minimal distance) measurements; transforming the garment block to 3D weft knitwear pattern by introducing horizontal and/or vertical darts; and translating the modified knitwear pattern to knitting diagrams and/or instructions, which can then be transferred manually to knitwear CAD system to control the automatic knitting machine to knit the required knitwear.

11 Claims, 6 Drawing Sheets

(51) Int. Cl.
*D04B 1/24* (2006.01)
*A41H 3/00* (2006.01)
*D04B 37/00* (2006.01)

(58) Field of Classification Search
USPC ..... 700/131–133, 141
See application file for complete search history.

(56) References Cited

U.S. PATENT DOCUMENTS 6,698,253 B2 * 3/2004 Stoll ..... D04B 15/66 66/232
6,725,124 B2 * 4/2004 Yan ..... A41H 3/007 345/581
6,880,367 B2 * 4/2005 Suzuki ..... D04B 37/02 66/232
6,907,310 B2 * 6/2005 Gardner ..... A41H 1/00 700/132
6,968,075 B1 * 11/2005 Chang ..... G06K 9/00214 382/111
7,079,134 B2 * 7/2006 Kung ..... G06T 17/00 345/420
7,379,786 B2 * 5/2008 Koichi ..... A41H 3/007 700/135
7,385,601 B2 * 6/2008 Bingham ..... A41H 3/007 345/419
7,657,340 B2 * 2/2010 Lind ..... A41H 3/007 345/419
7,657,341 B2 * 2/2010 Lind ..... A41H 3/007 700/131
7,805,213 B2 * 9/2010 Schwenn ..... D03D 13/00 139/425 R
8,165,711 B2 * 4/2012 Brooking ..... G06F 17/50 700/132
8,249,738 B2 * 8/2012 Lastra ..... A41H 3/007 700/132
8,571,698 B2 * 10/2013 Chen ..... G01B 11/2513 700/135
2005/0154487 A1 * 7/2005 Wang ..... A41H 3/007 700/132
2007/0250203 A1 * 10/2007 Yamamoto ..... G06T 19/00 700/132
2014/0277683 A1 * 9/2014 Gupta ..... G06F 17/50 700/132

* cited by examiner

```
course-size of block - size of block - change in wales - number of blocks to repeat | symbols
{c, 1,  , 1,  , 137,  , 1,  | , Initial}
{c, 1,  , 2,  , -72,  , 1,  | , P}
{c, 3,  , 2,  , 18,  , 2,  | , P}
{c, 7,  , 2,  , 1,  , 1,  | , P}
{c, 9,  , 2,  , 17,  , 2,  | , P}
{c, 13,  , 2,  , 1,  , 1,  | , P}
{c, 15,  , 56,  , 0,  , 1,  | , 1}
{c, 71,  , 4,  , -1,  , 1,  | , P}
{c, 75,  , 4,  , 1,  , 1,  | , P}
{c, 79,  , 10,  , 1,  , 1,  | , P}
{c, 89,  , 8,  , 1,  , 1,  | , P}
{c, 97,  , 4,  , -1,  , 1,  | , P}
{c, 101,  , 4,  , 1,  , 1,  | , P}
{c, 105,  , 6,  , 1,  , 1,  | , P}
{c, 111,  , 4,  , 1,  , 1,  | , P}
{c, 115,  , 8,  , 1,  , 1,  | , 1}
{c, 123,  , 9,  , 1,  , 1,  | , 1}
```

FIG. 7

FULLY FASHION KNITWEAR AND A METHOD AND SYSTEM FOR MAKING THREE-DIMENSIONAL PATTERNS FOR THE SAME

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CLAIM FOR FOREIGN PRIORITY

This application claims priority under the Paris Convention to the Hong Kong Patent Application No. 15103860.4 filed Apr. 21, 2015 and the Hong Kong Patent Application No. 15103861.3 filed Apr. 21, 2015; the disclosures of which are incorporated herein by reference in their entirety.

FIELD OF THE INVENTION

The present invention generally relates to garment manufacturing, and more particularly to generation of knitwear patterns.

BACKGROUND

There are primarily two approaches for making garment patterns: (1) traditional garment pattern design, and (2) computer-aided-design (CAD) garment pattern design.

In traditional garment pattern design, flat patterning and draping are two main methods for pattern making. The traditional garment pattern design method is time consuming and inconsistent because of the human manual operations by different people with different levels of skill. Thus, the fitting of garment cannot be ensured.

There are a number of prior arts describing how to use the traditional garment pattern design method to develop two-dimensional (2D) patterns or three-dimensional (3D) patterns of garments, and also how to improve the fitting of these garment patterns. These disclosures, however, cover mostly woven type garments.

The China Patent for Invention Application Publication No. CN1227082A discloses a method for creating knitted garments by forming an entirely deployed pattern having a deployed shape, which can be obtained by flattening an entire predetermined 3D design of a garment to be knitted. The disclosed method includes dividing the entirely deployed pattern into a plurality of divided area to form pattern pieces. Then, the pattern pieces are used to create knitted pieces, which conform to each shape of the pattern pieces. Lastly, the predetermined design of the garment is made by joining the knitted pieces to each other based on an arrangement of the divided area. This process is lengthy, complicated, and prone to human errors.

In the CAD garment pattern design, most existing methods comprise: (1) operating on 2D pattern (2D-to-2D approach), (2) flattening 3D surface to 2D pattern (3D-to-2D approach), (3) creating 2D cut-and-sewn garment from 3D data cloud (3D-to-2D approach with equipment), (4) designing 2D garment with the help of 3D simulation mannequin and garment (2D-to-3D approach), (5) creating 3D garment from 3D human model or human body data (3D-to-3D approach), (6) performing CAD garment pattern simulation, which includes the simulation of the mannequin on computer, simulation the garment on computer, and simulation the fitting of a virtual mannequin on computer.

SUMMARY OF THE INVENTION

It is the objective of the present invention to provide a method and system for forming an entirely deployed pattern based on a 3D design according to the contours of wearer and making a knitted garment, such that the resulting knitted garment feels custom-tailored, snugly fits to the body, and allows uninhibited body movements.

In accordance to an embodiment of the present invention, a custom-fit 3D fashion knitwear system is provided that is different from the existing systems in the following ways:

1. It includes a 3D data cloud to 3D knitwear panel (3D-to-3D) application for weft knitting machines;
2. It is capable of taking a 2D woven pattern and transforming it for 3D knitwear panel, as compare to existing 2D-to-3D methods that are based on woven garments only.

In accordance to one aspect, the present invention provides a method of calculating the body measurements and the basic blocks of the individual surface patches using the digitized 2D basic block pattern or 3D body data cloud, to generate a contour fit 3D knitwear pattern automatically. It is a 3D-to-3D computer aided design system, because the invention can facilitate the production 3D fully fashion knitwear via the knitting instructions, as opposed to the cut-and-sewn manufacturing method.

BRIEF DESCRIPTION OF THE DRAWINGS

Embodiments of the invention are described in more detail hereinafter with reference to the drawings, in which:

FIG. 7 shows the 3D knit instruction translated from the 3D knitwear pattern.

DETAILED DESCRIPTION OF THE INVENTION

In the following description, methods and systems for forming an entirely deployed pattern based on a 3D design according to the contours of wearer and making a knitted garment and the likes are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
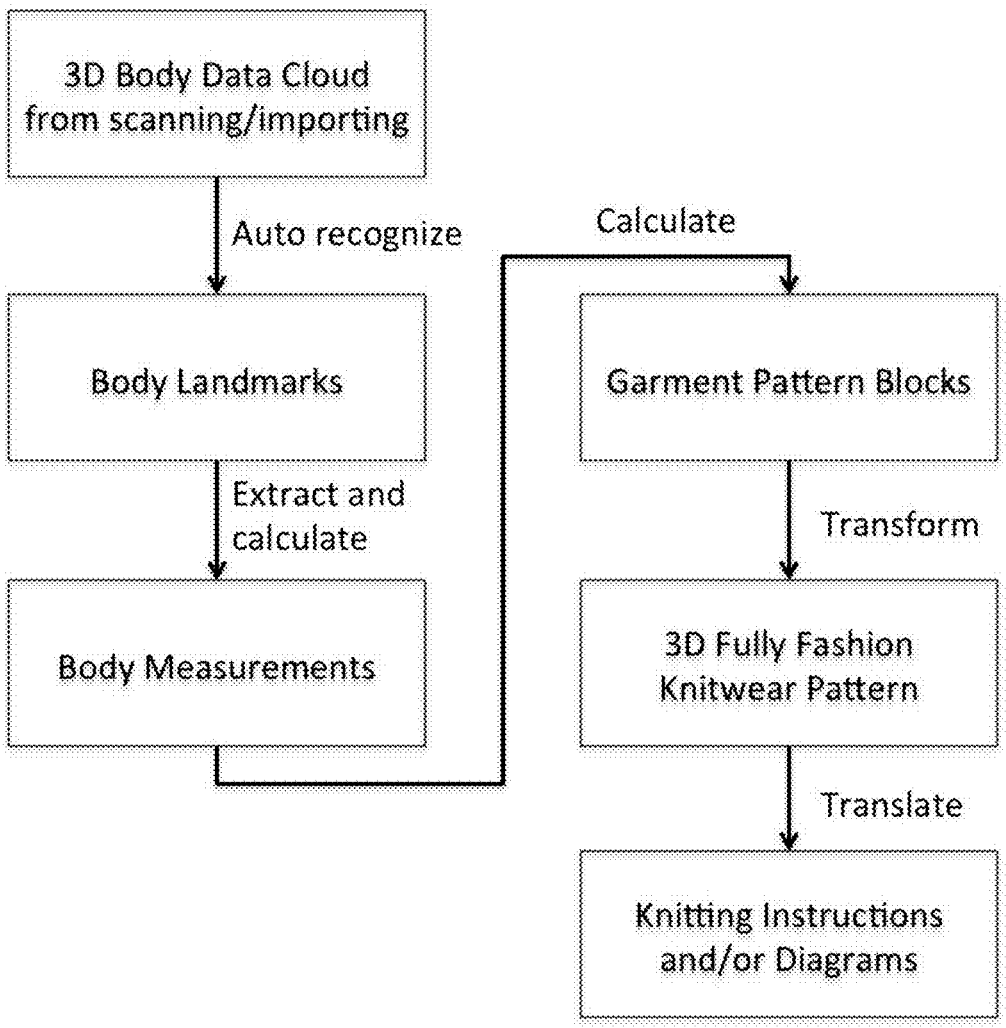
FIG. 1 shows a flow chart of a method for forming an entirely deployed pattern based on a 3D design according to the contours of wearer and making a knitted garment in accordance to an embodiment of the present invention.

Referring to FIG. 1. In accordance to one aspect of the present invention, a computer-implementable method of generating a contour fit 3D fully fashion knitwear pattern directly from 3D digitalized surface is provided. The method includes the capturing of 3D body data, the automatic recognition of the body landmarks, the calculation of the body measurements, the generation of basic blocks and in turn into 3D knitwear pattern, and the translation of the 3D knitwear pattern to knitting instructions. More generally, the preferred embodiment further contemplates the whole body knitwear pattern generation.

Figure 2:
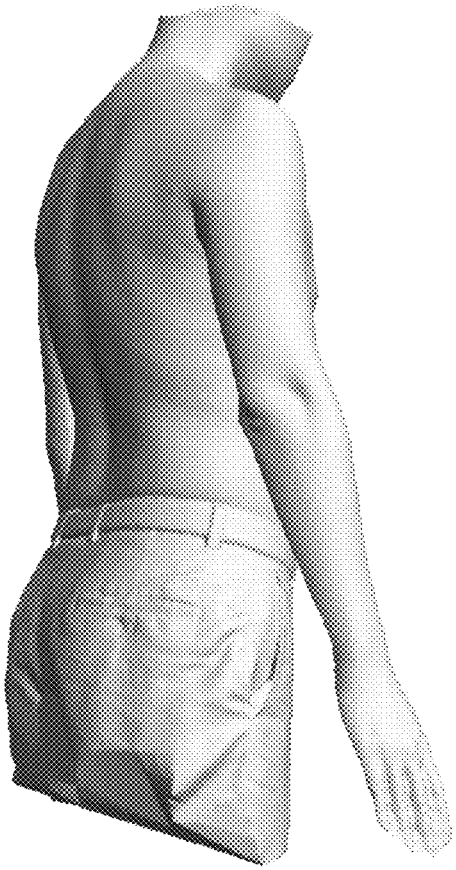
FIG. 2 shows a scanned image obtained by a body scanner in accordance to an embodiment of the present invention.

The method begins by taking input of digitized 2D pattern blocks, or a 3D body data cloud of a mannequin or a human body. For taking input of a 3D body data cloud of a mannequin or a human body, a mannequin or an individual's body is scanned, for instance, by using a 3D body scanner to create a 3D body data cloud. The 3D body data cloud comprises a plurality of 3D data points from a plurality of split scanning sets. The 3D data points from each split scanning set are then joined to form a whole 3D scanned image. FIG. 2 shows an exemplary scanned image. The human subject to be scanned is required to stand steadily with her feet apart and arms open. This posture allows normally visually covered areas to be revealed and facilitates the subsequent feature recognition.

In analyzing the 3D data points, cross-sectional data planes that are within a vertical distance range of 2 mm-6 mm can be synthesized as one single cross section to improve the body landmarks and features recognition and measurement extraction process efficiency. And then the limbs and torso body parts are recognized referring to the structure of the cross sections.

For taking input of digitized 2D pattern blocks, existing garment pattern blocks, which can be draped or drafted, are imported and transformed into a knitwear pattern by introducing horizontal and/or vertical darts.

Figure 3:
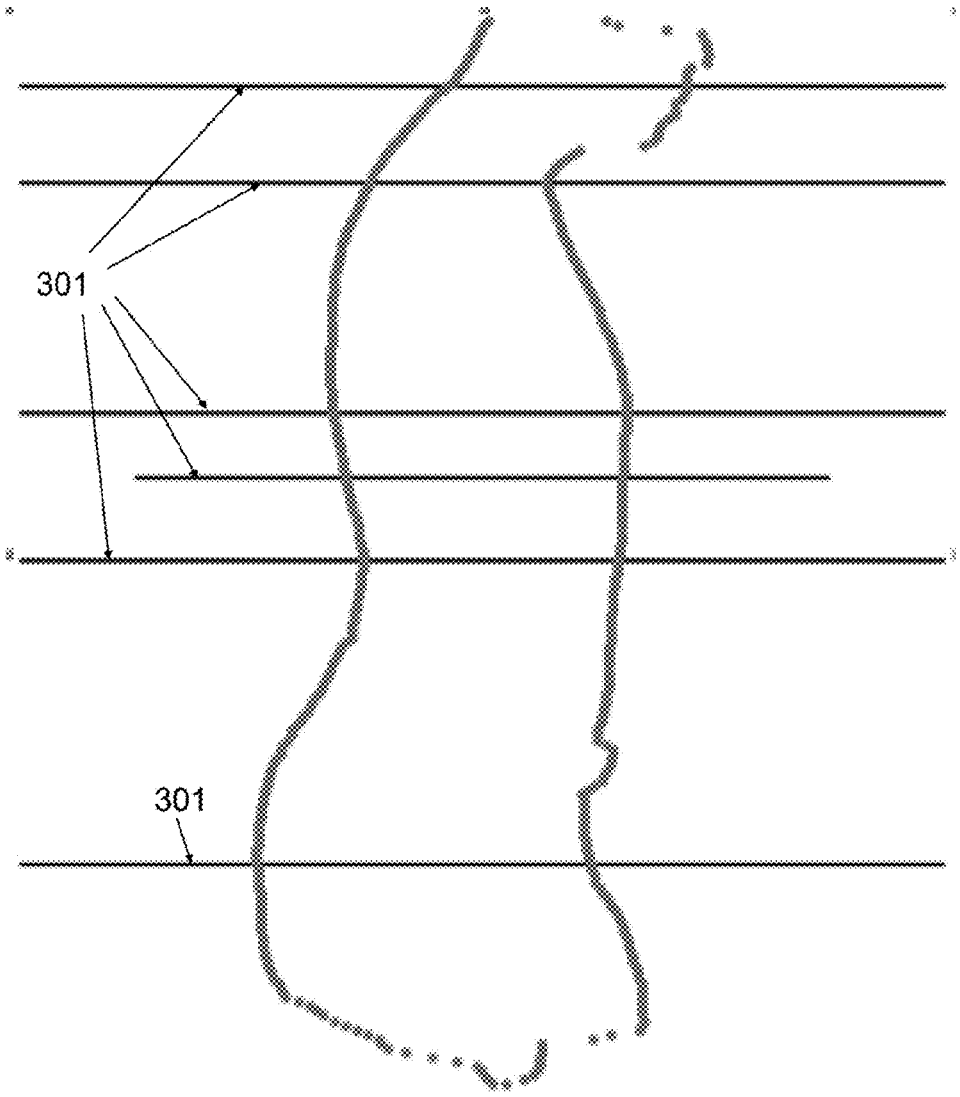
FIG. 3 shows the body landmarks of the scanned image.

The next step is to recognize the body landmarks based on the cross sections 301 as shown in FIG. 3. The recognition of body landmarks is by means of a table of definitions; the landmarks can be biologically defined or artificially defined by user according to a garment style. The body landmarks and feature recognition process is as follow: (1) generate the front and back profile curve of the body, which is represented by the extreme points of each cross-section of the data cloud with respect to the sagittal plane, and the knee, hip, waist, bust, neck etc. can be recognized; (2) generate the left and right profile curve of the body, which is represented by the extreme points of each cross-section of the data cloud with respect to the frontal plane, and the crotch, wrist, elbow, underarm, shoulder etc. can be recognized. Then in the third step, the body measurements are calculated using the body landmarks.

Figure 4:
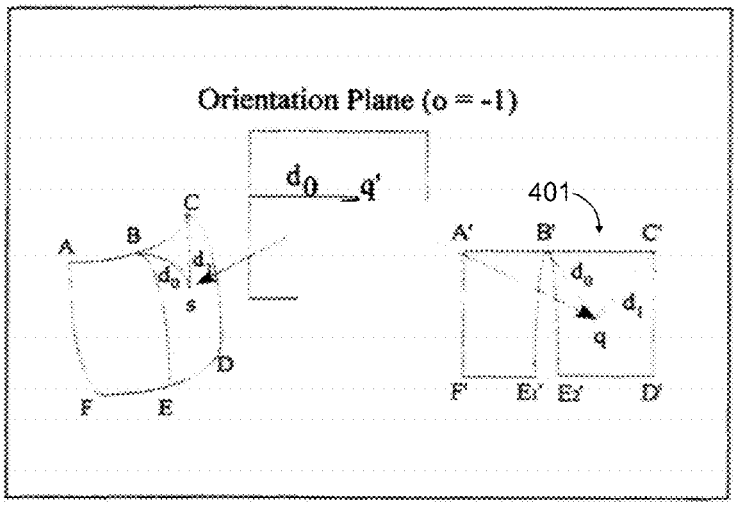
FIG. 4 shows the mapping process from measurements to a 3D knitwear bodice pattern in accordance to an embodiment of the present invention.
Figure 5:
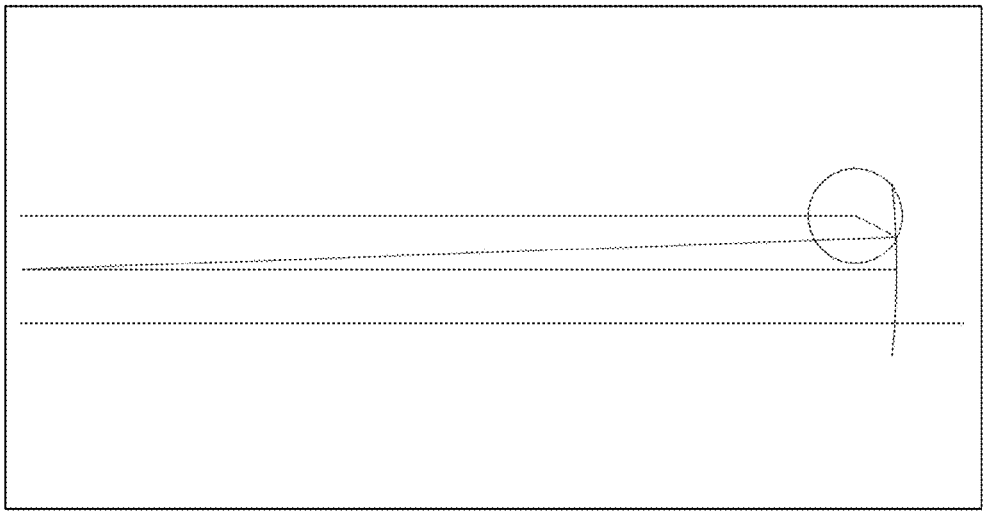
FIG. 5 shows the adjustment process for transforming a 3D knitwear sleeve pattern after tracing out the cross-sectional sampling reference points in accordance to an embodiment of the present invention.

In the forth step of garment pattern block generation, basic blocks of the digitized surface patches of the individual are generated according to the geodesic (minimal distance) measurements of the biological and artificial body landmarks that meet a set of pre-defined conditions. An exemplary basic block 401 and its generation are illustrated in FIG. 4. The garment style also influences the shape of the basic blocks. Hence, different styles may generate different basic blocks. The basic block pattern is an immediate pattern to be transformed into a knitwear pattern by introducing horizontal and/or vertical darts, which are formation devices to create 3D shape of the knitwear. The knitwear pattern can be modified for different knitting machines. The result is a contour fit 3D fully fashion knitwear pattern, such as that shown in FIG. 6. The vertical and horizontal darts (i.e. the dart 601 that is corresponding to the waist and the dart 602 that is corresponding to the bust) on the contour fit 3D fully fashion knitwear pattern are the key formation devices. These vertical and horizontal darts allow the precise formation of curves and 3D-shaped structures of the finished knitwear garment.

In accordance to one embodiment, the shape of the garment pattern block of the bodice is calculated according to the following stereographic method. For the front/back bodice pattern block, the horizontal pattern reference line is defined by bust/chest line, whereas the vertical pattern reference line is defined by the center front/back line respectively. The origin is set at the intersecting point of the vertical and horizontal reference lines. Two reference points are defined to be the origin and the bust/chest point. All landmark points are mapped from 3D to 2D by preserving the distance from the two reference points. The sequence of mapping is important so that a horizontal gap can naturally exist at the bust/chest level. This gap becomes the horizontal dart.

Figure 6:
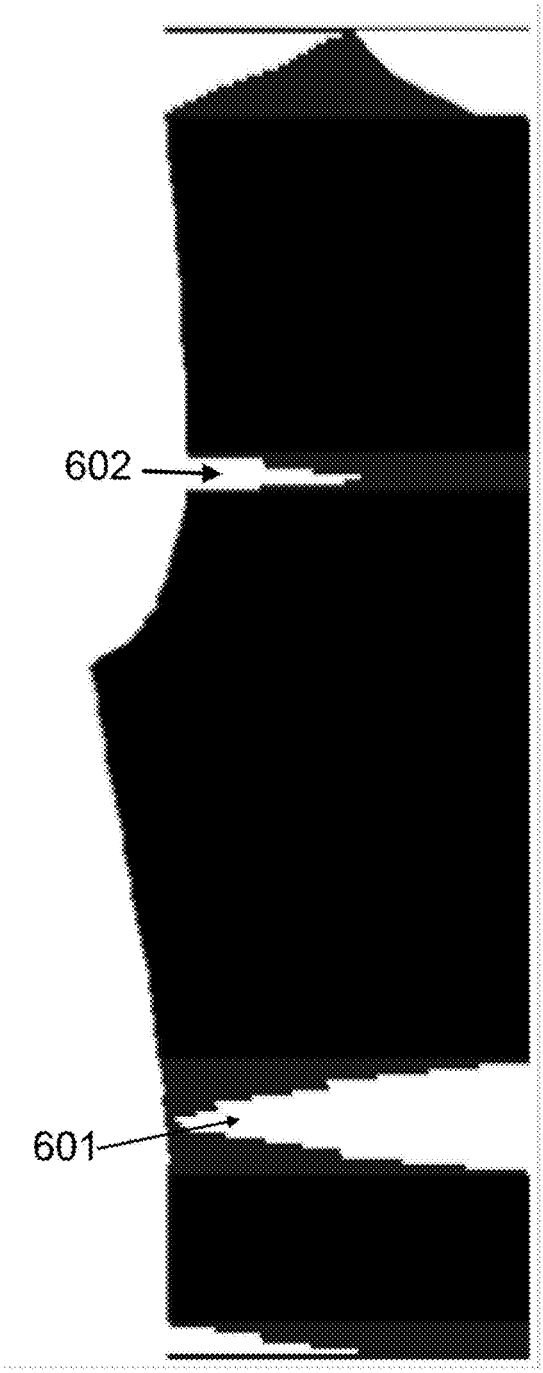
FIG. 6 shows the 3D knitwear pattern for bodice.

Firstly, consider the data cloud from neck to the waist. The mapping process starts with the side seam at the bust level. This point is mapped, and then following the clockwise direction, other points are mapped until the starting point is mapped again as the final point. This final image and the first image are different but are mirror image of one another with respect to the bust line. This is the horizontal dart 602 as shown in FIG. 6. The exact sequence of the points is not important, but the final shape of the pattern is important. Secondly, consider the data cloud below waist and above hip. The mapping process starts with the intersection of the center line and the waist line and then following the clockwise direction, other points are mapped until the side seam of the hip level is mapped. This image is taken to lie above the hip line. A waist dart 601 is formed as shown in FIG. 6. Once again, the sequence for the points is not important, but the final shape of the pattern is important. If desired, this horizontal dart can be partially or fully rotated to create a vertical dart. If required, the shape of the bodice pattern block can be furthered smoothed out so that the final appearance can be improved.

In accordance to another embodiment, the shape of the garment pattern block of the sleeve is calculated according to the following stereographic method. For the sleeve pattern block, the horizontal pattern reference line is defined by armhole line, whereas the vertical pattern reference line is defined by the top sleeve side seam line. The origin is set at the intersecting point of the vertical and horizontal reference lines. In phase one, the horizontal distance of all the landmark points located at the side seam of the underside of the sleeve of each cross-section of the data cloud from the vertical reference line is calculated and are mapped from 3D to 2D by preserving the distance and the angle. So, a 2D grid is formed. In phase two, starting from the sleeve head, the vertical distance of each pair of the landmark points is preserved by bending the grid. The process stops at the elbow. Then, there is a natural gap being created between the landmark elbow point because there are two direction of tracing resulting in two images of the same point. This gap is the elbow dart. If the natural dart is not horizontal, it must be rotated to become horizontal. If required, the shape of the sleeve pattern block can be furthered smoothed out so that the final appearance can be improved.

In accordance to one embodiment, the horizontal and/or vertical darts on the knitwear pattern generated are reorganized and combined using dart rotations. Consequently, only one dart corresponding to the waist, one dart corresponding to the bust, and one or more style-based darts are left on the resulting contour fit 3D fully fashion knitwear pattern.

Finally, the contour fit 3D fully fashion knitwear pattern is translated to knitting instructions and/or knitting diagrams, such as that shown in FIG. 7, which can be used to feed into computer aided knitwear design system to control the knitting machine to knit the required knitwear.

In accordance to one embodiment, the translation of contour fit 3D fully fashion knitwear pattern to knitting instructions and/or knitting diagrams is performed by a knitting machine simulation program.

In accordance to another embodiment, the translation of contour fit 3D fully fashion knitwear pattern to knitting instructions and/or knitting diagrams includes enhancement instructions of: (1) partial knitting at the hem to enforce the leveling of the 3D knitwear, (2) transfer knit along the shaped contour of the 3D knitwear, (3) partial knit at the horizontal dart with reinforcement courses, and (4) partial knit at the shoulder. The type of knitting loop can be flexible as it contributes to the over all appearance and the design of the knitwear itself. These enhancements instructions define the fitting but not the pattern design.

The embodiments disclosed herein may be implemented using a general purpose or specialized computing device, computer processor, or electronic circuitry including but not limited to a digital signal processor (DSP), application specific integrated circuit (ASIC), a field programmable gate array (FPGA), and other programmable logic device configured or programmed according to the teachings of the present disclosure. Computer instructions or software codes running in the general purpose or specialized computing device, computer processor, or programmable logic device can readily be prepared by practitioners skilled in the software or electronic art based on the teachings of the present disclosure.

In some embodiments, the present invention includes a computer storage medium having computer instructions or software codes stored therein which can be used to program a computer or microprocessor to perform any of the processes of the present invention. The storage medium can include, but is not limited to, floppy disks, optical discs, Blu-ray Disc, DVD, CD-ROMs, and magneto-optical disks, ROMs, RAMs, flash memory devices, or any type of media or device suitable for storing instructions, codes, and/or data.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A computer-implemented method of making a knitted garment by generating a knitwear pattern for a contour fit three-dimensional (3D) fully fashion knitwear directly from a 3D digitalized surface, the method comprising:

digitizing a body surface of an individual or a mannequin to create a 3D body data cloud;

recognizing one or more body landmarks from the 3D body data cloud;

extracting one or more body measurements including geodesic measurements from the 3D body data cloud;

generating one or more garment pattern blocks according to the extracted body measurements including geodesic measurements and a garment style; and transforming the garment pattern blocks to a knitwear pattern to be used in knitting the knitted garment by introducing one or more horizontal and vertical darts;

wherein the geodesic measurements are measurements of shortest distance in 3D space between two points on the body surface; and wherein the horizontal and vertical darts are formation devices to create 3D-shaped structures of the knitted garment.

2. The method of claim 1, further comprising importing existing garment pattern blocks in place of digitizing a body surface of an individual or a mannequin to create a 3D body data cloud and generating one or more garment pattern blocks according to the extracted body measurements including geodesic measurements and a garment style.

3. The method of claim 1, wherein the digitization of a body surface of an individual or a mannequin to create a 3D body data cloud is performed by capturing the body surface by a handheld scanner or a full-body scanner.

4. The method of claim 1, wherein the recognition of one or more body landmarks is by means of a table of definitions, manually defined by a user according to the garment style, or automatically by identifying one or more extreme protrusion points and extreme recess points on the body surface.

5. The method of claim 1, wherein shapes of the garment pattern blocks are calculated according to the extracted body measurements including geodesic measurements of the biological and artificial defined body landmarks, satisfying a set of pre-defined conditions.

6. The method of claim 1, further comprising translating the knitwear pattern to one or more knitting instructions or diagrams which are input to a computer-aided knitwear design system to control a knitting machine to knit the knitwear.

7. The method of claim 1, further comprising reorganizing and/or combining the horizontal and/or vertical darts using dart rotations such that consequently, only one dart corresponding to the waist, one dart corresponding to the bust, and one or more style-based darts are left on the knitwear pattern.

8. The method of claim 5, wherein the shapes of the garment pattern blocks are determined by a stereographic process comprising:

defining a horizontal pattern reference line for a front/back bodice garment pattern block using a bust/chest line on the body;

defining a vertical pattern reference line for a front/back bodice garment pattern block using a center front/back line on the body;

defining an origin reference point as being an intersecting point of the horizontal pattern reference line and the vertical pattern reference line;

defining a bust/chest reference point;

mapping the body landmarks from 3D to 2D by preserving a first distance of each of the body landmarks from the origin reference point and a second distance of each of the body landmarks from the bust/chest reference point;

determining the one or more horizontal darts from the resulting 2D mapping of the body landmarks;

rotating one or more of the horizontal darts to create one or more of the vertical darts; and smoothing out the shapes of one or more of the garment pattern blocks if necessary.

9. The method of claim 5, wherein the shapes of the garment pattern blocks corresponding to sleeves are determined by a stereographic process comprising:

defining a horizontal pattern reference line using an armhole line on the body;

defining a vertical pattern reference line using a top sleeve side seam line on the body;

defining an origin reference point as being an intersecting point of the horizontal pattern reference line and the vertical pattern reference line;

mapping the body landmarks located at a side seam of an underside of the sleeve from 3D to 2D by: first preserving a horizontal distance and an angle of each of the body landmarks from the vertical reference line to form a 2D grid, then starting from the sleeve head and ending at elbow preserving a vertical distance of each pair of the body landmarks by bending the 2D grid;

determining an elbow dart from the resulting 2D mapping of the body landmarks;

rotating the elbow dart if the elbow dart is not horizontal to create a horizontal dart; and smoothing out the shapes of one or more of the garment pattern blocks if necessary.

10. The method of claim 6, wherein the translation of the knitwear pattern to the knitting instructions or diagrams comprises enhancement instructions including:

(1) partial knitting at a hem to enforce leveling of the knitwear, (2) transfer knit along shaped contour of the knitwear, (3) partial knit at the horizontal darts with reinforcement courses, and (4) partial knit at shoulder.

11. A three-dimensional (3D) fully fashion knitwear made without cutting and sewing and by using a knitwear pattern generated by the method of claim 1.

* * * * *